US006918490B1

(12) United States Patent
Napolitano

(10) Patent No.: US 6,918,490 B1
(45) Date of Patent: Jul. 19, 2005

(54) THREADING KIT AND A METHOD FOR THREADING AN OBJECT

(76) Inventor: Steve Napolitano, 5748 Gulley, Dearborn Heights, MI (US) 48127

( * ) Notice: Subject to any disclaimer, the term of this patent is extended or adjusted under 35 U.S.C. 154(b) by 96 days.

(21) Appl. No.: 10/435,506

(22) Filed: May 9, 2003

(51) Int. Cl.[7] ..... B65D 69/00
(52) U.S. Cl. ..... 206/574; 206/575; 206/227
(58) Field of Search ..... 206/49, 227, 388, 206/575, 574; 223/99, 106, 107; 66/117

(56) References Cited

U.S. PATENT DOCUMENTS

D87,509 S * 8/1932 Collingbourne ..... D9/700
2,353,875 A * 7/1944 Burnham ..... 66/117
3,384,220 A * 5/1968 Linstead ..... 206/574
3,872,968 A * 3/1975 Hawkins et al. ..... 206/278
4,032,012 A * 6/1977 Bishop ..... 206/574
4,127,191 A * 11/1978 Cave ..... 206/574
4,195,496 A * 4/1980 Vasquez et al. ..... 66/117
5,150,794 A * 9/1992 Rooks ..... 206/574
5,509,653 A * 4/1996 Parsons ..... 463/47.7

* cited by examiner

*Primary Examiner*—David T. Fidei
(74) *Attorney, Agent, or Firm*—Law Offices of John Chupa & Associates, P.C.

(57) ABSTRACT

A threading kit (10) having a first threading assembly (11), a second threading assembly (20), a package of leather lace (38), and a carrying case (42) which holds and protects the first threading assembly (11), the second threading assembly (20), and the leather lace (38). Particularly, the leather lace (38) is removably coupled to either the first or the second threading assembly (11, 20) and is used to either pierce a material or perform a re-lacing or threading task.

5 Claims, 2 Drawing Sheets

THREADING KIT AND A METHOD FOR THREADING AN OBJECT

FIELD OF THE INVENTION

The present invention generally relates to a threading kit and a method for threading an object and, more particularly, a threading kit which includes a plurality of threading assemblies of different shapes and sizes which allow a user to select an appropriate threading assembly to perform a threading task in a cost effective and efficient manner.

BACKGROUND OF THE INVENTION

Oftentimes, objects, such as and without limitation footwear, garments, and/or substantially any type of apparel (e.g., shoes, boots, moccasins, pants, coats, shirts, and the like) are secured upon an individual by use of lacing and either apertures or eyelets within the apparel through which the lacing is traversed and fastened or tied. Particularly, conventional lacing, such as and without limitation, leather lacing may degrade over time, become brittle and break, or become un-laced, thereby rendering the apparel un-wearable until such time that the lacing can be replaced or re-laced. More particularly, the task of leather re-lacing may be very difficult for an individual to perform if the individual is not a professional (e.g., a shoe repair person, a tailor, a seamstress, and/or the like) or does not have access to or own the proper tools to perform a re-lacing task without damaging the apparel which requires re-lacing.

Previous methods for re-lacing or performing a "threading" task include, but are not limited to: an individual manually forcing a leather lace through a plurality of apertures or eyelets; and an individual paying a professional to repair or re-lace apparel. Both of these previous methods each suffer from some drawbacks.

For example and without limitation, an individual manually forcing a leather lace through a plurality of apertures or eyelets may be very difficult not to damage if the apparel is made form a delicate material. That is, a material, such as and without limitation, suede, silk, leather, and/or the like may have relatively small punctures or apertures through the material which originally received a leather lace which served to fasten the relatively delicate material around a portion of an individual's body. These punctures through the material may be ripped, torn, stretched, or otherwise undesirably altered if and/or when an individual attempts to forcibly thread a leather lace through them, which may potentially ruin or render the apparel unusable. In the case that the punctures or apertures are damaged, an individual must either throw the apparel away or pay a professional to attempt to fix the damage, both of which result in a substantial cost (i.e., either paying to replace the apparel or paying to have the apparel professionally repaired). Moreover, some types of apparel, such as leather boots or work boots oftentimes include eyelets which are shrouded or obstructed by another portion of the boot (e.g., the tongue of the boot can obstruct the eyelets of the boot to the point which a conventional leather lace may not easily pass through the eyelet or aperture).

In further example and without limitation, an individual paying a professional to repair or re-lace apparel requires the individual to travel to a qualified repair person, leave the damaged or un-laced apparel with the repair person, wait an amount of time until the repair person has completed the repair or re-lacing of the apparel (e.g., if the repair person can complete the repair or re-lacing while the individual waits), travel or return to the location from where the individual originally traveled from, wait for the repairs or re-lacing to be performed by the professional repair person (e.g., if the repair person cannot perform the repair while the individual waits, the wait is oftentimes more than twenty-four hours or one business day), travel back to the repair person when the repair or re-lacing has been performed, pay a monetary amount for the services provided by the repair person, and finally travel to where the individual first traveled from.

This previous method for paying a professional to re-lace or repair apparel not only requires an expenditure of money on every occasion which apparel needs re-lacing or repairing, but it requires a significant amount of waiting, a significant amount of traveling, and a significant amount of time which the individual cannot wear the apparel which requires re-lacing or repair.

There is therefore a need for a method which allows an individual to perform a threading task. There is also a need for a method which allows a non-professional individual to quickly, conveniently, reusably, and cost-effectively perform a threading task themselves, and which overcomes some or all of the previously delineated drawbacks of prior pressurized storage container heating methods.

The present invention addresses these and other needs in a new and novel manner, as will be discussed in the following description of preferred, embodiments, within the appended claims, and with reference to the following drawings.

SUMMARY OF THE INVENTION

A first non-limiting advantage of the present invention is that it provides a threading kit which allows for the selective threading or lacing of apparel in a manner which overcomes the previously delineated drawbacks of prior threading or lacing methodologies.

A second non-limiting advantage of the invention is that it provides a threading kit which allows for the selective threading or lacing of apparel, allows for the selective creation of apertures in apparel, and provides a substantially durable and protective carrying case which holds and protects all of the components of the threading kit.

A third non-limiting advantage of the present invention is that it provides a method for making a threading kit.

A fourth non-limiting advantage of the present invention is that it provides a threading kit comprising at least one threading assembly which is generally tubular in shape, the at least one threading assembly having a first end, a second end, and a hollow body portion, wherein the first end comprises an aperture which allows access to a generally hollow cavity of the body portion, and wherein the second end is generally conical in shape and terminates at a substantially sharp point; at least one package of lace; and a carrying case having a substantially soft filler material which separates the first threading assembly, the second threading assembly, and the package of leather lace.

A fifth non-limiting advantage of the present invention is that it provides A threading kit comprising a first threading assembly which is generally tubular in shape, the first threading assembly having a first end, a second end, and a hollow body portion, wherein the first end comprises an aperture which allows access to a generally hollow cavity of the body portion, and wherein the second end is generally conical in shape and terminates at a substantially sharp point; a second threading assembly which is generally tubular in shape, the second threading assembly having a first end, a second end, a generally hollow body portion, and a fixed position elbow portion, wherein the first end comprises an aperture which allows access to a generally hollow cavity of the body portion, wherein the second end is generally conical in shape and terminates in a substantially sharp point, and wherein the second end is bent at an acute angle from the body portion at the fixed position elbow portion; at least one package of lace; and a carrying case having a substantially soft filler material which separates the first threading assembly, the second threading assembly, and the package of leather lace.

A sixth non-limiting advantage of the present invention is that it provides a method for making a threading kit. Particularly, the method comprises the steps of providing a first threading assembly which is generally tubular in shape, the first threading assembly having a first end, a second end, and a hollow body portion, wherein the first end comprises an aperture which allows access to a generally hollow cavity of the body portion, and wherein the second end is generally conical in shape and terminates at a substantially sharp point; providing a second threading assembly which is generally tubular in shape, the second threading assembly having a first end, a second end, a generally hollow body portion, and a fixed position elbow portion, wherein the first end comprises an aperture which allows access to a generally hollow cavity of the body portion, wherein the second end is generally conical in shape and terminates in a substantially sharp point; bending the second end at an acute angle from the body portion at the fixed position elbow portion; providing at least one package of lace; providing a carrying case; providing a substantially soft filler material; and disposing the substantially soft filler material within the carrying case.

These and other features, aspects, and advantages of the present invention will become apparent from a reading of the following detailed description of the preferred embodiment of the invention and by reference to the following drawings.

DETAILED DESCRIPTION OF THE PREFERRED EMBODIMENT OF THE INVENTION

The present invention may be understood more readily by reference to the following detailed description of preferred embodiments of the invention.

Before the present methods and apparatuses are disclosed and described, it is to be understood that the terminology used herein is for the purpose of describing particular embodiments only and is not intended to be limiting. It must be noted that, as used in the specification and the appended claims, the singular forms "a", "an", and "the" include plural referents unless the context clearly dictates otherwise.

Figure 1:
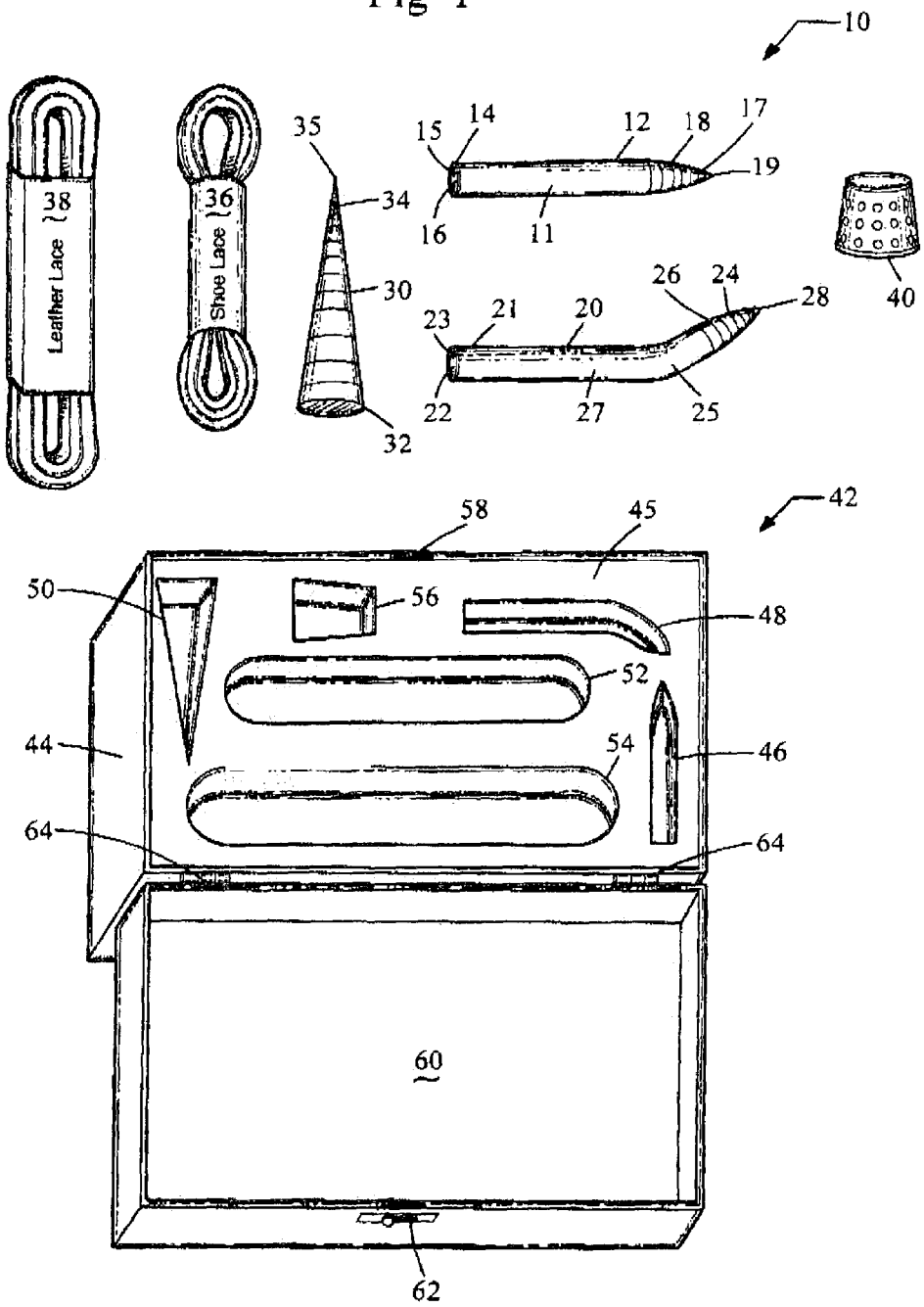
FIG. 1 is a partial perspective view of a threading kit which is made in accordance with the teachings of the preferred embodiment of the invention.

Referring now to FIG. 1, there is shown a threading kit 10 which is made in accordance with the teachings of the preferred embodiment of the invention. As shown threading kit 10 includes a first threading assembly 11, a second threading assembly 20, an awl 30, a package of shoelace 36, a package of leather lace 38, a thimble 40, and a carrying case 42.

Particularly, the first threading assembly 11 is generally hollow and tubular in shape and includes a body portion 12 having a first end 14 having an aperture 15 which leads to a generally hollow cavity 16. The first assembly 11 further includes a second end 17 having a tapered portion 18 which terminates at a generally pointed or sharp end 19. It should be appreciated that the length and diameter of the generally tubular shaped first assembly 11 is not limited to any particular length or diameter. Rather, the length and diameter of the first assembly 11 may be substantially any desired length or diameter.

The second threading assembly 20 is generally hollow and tubular in shape and includes a body portion 27 having a first end 21 having an aperture 22 which leads to a generally hollow cavity 23. The second assembly 20 further includes a second end 24 having a tapered portion 26 which terminates at a generally pointed or sharp end 28. More particularly, the second end 24 further includes a fixed position elbow portion 25 which bends from the body portion 27 at an acute angle. It should be appreciated that the length and diameter of the generally tubular shaped second assembly 20 is not limited to any particular length or diameter. Rather, the length and diameter of the second assembly 20 may be substantially any desired length or diameter. It should be further appreciated that the acute angle formed by the fixed position elbow portion 25 is not limited to any particular angle. Rather, as should be understood by one who is skilled in the relevant art, the angle that is created by the elbow portion may be substantially any desired angle. For example and without limitation, the angle of the fixed position elbow portion 25 may be approximately fifteen to eighty-nine degrees.

In one non-limiting embodiment of the invention, the second end 24 of the second assembly 20 may "curl" or bend arcuately at approximately one-hundred and eighty degrees from the body portion 27 (i.e., the second assembly 20 may be substantially "fish-hook" shaped).

The awl 30 is a conventional and generally conical awl which has a first wide end 32 and a second narrow end 34 which terminates in a substantially sharp point 35. The conventional thimble 40 may be constructed out of substantially any desired and substantially rigid material (e.g., metal, plastic, Kevlar, rubber, and/or the like). The package of shoe lace 36 is a conventional and commercially available package of shoelace and the package of leather lace 38 is a conventional and commercially available package of leather lace. It should be appreciated that the package of shoelace 36 may be substantially any desired length, material, and color. For example and without limitation, the conventional package of shoelace 36 may comprise a pair of white sneaker or tennis shoe shoelaces which are each approximately thirty-five to fifty-five inches in length. In further example and without limitation, the conventional package of shoelace 36 may comprise a pair of conventional black dress shoe shoelaces which are each approximately fifteen to thirty-five inches in length.

It should be appreciated that the package of leather lace 38 may be substantially any desired length and color (i.e., leather lace may be died to substantially any desired color) and, nothing within this description should be construed as limiting the length or color of the leather lace 38.

The carrying case 42 includes a base portion 44 which is movably coupled to a lid portion 60 by two substantially identical hinges 64. Particularly, the base portion 44 includes a substantially soft and conformable filler material 45 (e.g., foam) which includes several dissimilar recesses 46, 48, 50, 52, 54, and 56. More particularly, the recess 46 is shaped is shaped substantially similar to the first threading assembly 11 and is adapted to removably receive and hold the first assembly 11. The recess 48 is shaped substantially similar to the second threading assembly 20 and is adapted to removably receive and hold the second assembly 20. The recess 50 is shaped substantially similar to the conventional awl 30 and is adapted to removably receive and hold the awl 30. The recess 52 is shaped substantially similar to the conventional package of shoelace 36 and is adapted to removably receive and hold the conventional package of shoelace 36.

The recess 54 is shaped substantially similar to the conventional package of leather lace 38 and is adapted to removably receive and hold the conventional package of leather lace 38. The recess 56 is shaped substantially similar to the conventional thimble 40 and is adapted to removably receive and hold the conventional thimble 40. It should be understood that the substantially soft and conformable filler material 45 is employed to both protect the individual components of the kit 10. (i.e., 11, 20, 30, 36, 38, and 40) from contacting each other while within the carrying case 42, as well as provide acoustic dampening of the kit 10 (e.g., the material 45 muffles the sound that would be otherwise made by the components if the components were disposed within a substantially rigid or "non-soft" material, such as molded plastic). It should be further appreciated that the kit 10 may incorporate more or less components than the number of components which are depicted within the FIGS. 1–2. For example and without limitation, the kit 10 may include more than one package of conventional shoelace 36 and, in this non-limiting example, the carrying case 42 would also be adapted to removably receive and hold more than one package of conventional shoelace 36 (e.g., the filler material 45 would include more than one recess shaped like the package of shoelace 52 and the carrying case would be made larger to incorporate the more than one recess).

In further example and without limitation, the kit 10 may include other components (not shown) which are used by professionals to perform a lacing task or repair (e.g., various sized eyelets, leather shears, and/or the like) and, similarly, the carrying case 42 would be adapted to removably receive and hold any added components (i.e., the carrying case 42 would be made larger and the filler material 45 would be adapted with recesses which are shaped substantially similar to the added components).

Figure 2A:
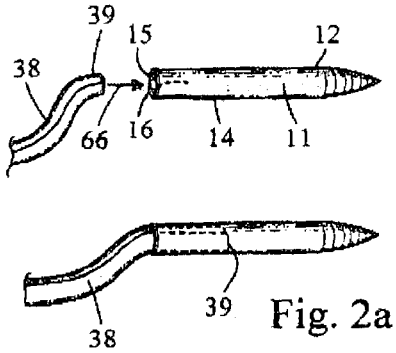
FIG. 2*a* is a partial perspective view of a threading assembly in a disassembled relationship with a portion of lace and in an assembled relationship with a portion of lace.

As best shown in FIG. 2*a*, a portion of the leather lace 38 is shown remote from the first threading assembly 11. As shown, the portion of leather lace 38 is inserted into the threading assembly 11, such that the end 39 is inserted into the cavity 16 in the direction of the arrow 66. The end 39 of the leather lace frictionally fits within the cavity 16, such that the end 39 frictionally engaged the inner race of the body portion 12 of the first assembly 11, effective to removably couple the leather lace 38 within the first threading assembly 11, thereby allowing a threading task to be performed. It should be appreciated that the second threading assembly 20 may be coupled to either the shoelace 36 or the leather lace 38 in substantially the same process as described above with reference to the first threading assembly 11. It should be further appreciated that the first threading assembly may also be coupled to the shoelace 36 and, that both the first and the second assemblies 11, 20 may be coupled to substantially any desired size, length, and/or width conventional or commercially available apparel lace or shoelace (i.e., the first and the second threading assemblies 11, 20 may be of substantially any desired size and may be adapted to removably couple to substantially any desired size of apparel lace and/or shoelace). It should also be appreciated that the assemblies 11, 20 may be quickly and easily uncoupled to the shoelace 36 or the leather lace 38 (e.g., by pulling the lace 36, 38 in the opposite direction of the assemblies 11, 20) and, in this manner, the assemblies 11, 20 are reusable.

Figure 2B:
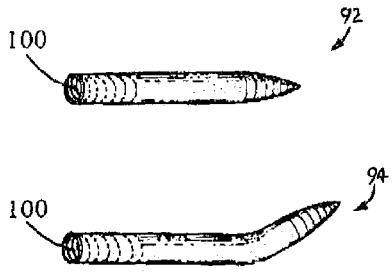
FIG. 2*b* is a partial perspective view of an alternate embodiment of the invention.

Referring now to FIG. 2*b*, there is shown an alternate embodiment of the threading assemblies 11, 20. More particularly, the assemblies 92, 94, are substantially identical to the assemblies 11, 21 with the exception that the assemblies 92, 94 include threading which traverses a portion of the inner races of both the assemblies 92, 94. That is, conventional leather lace, such as and without limitation, lace 38 may be selectively "twisted" or screwed into the assemblies 92, 94, (i.e., the leather lace 38 will cooperate with the threading 100 to frictionally and threadingly engage the lace 38 to either of the assemblies 92, 94, thereby providing a substantially secure coupling of the lace 38 to the assemblies 92, 94). It should be appreciated that the threading 100 of both of the assemblies 92, 94 further allow a user to pull upon the threading assemblies 92, 94 without the lace 38 becoming uncoupled to the assemblies 92, 94. Moreover, it should also be appreciated that the selective coupling of the assemblies 92, 94 to the lace 38 may be easily and selectively uncoupled and, in this manner, the assemblies 92, 94 are reusable.

Figure 3:
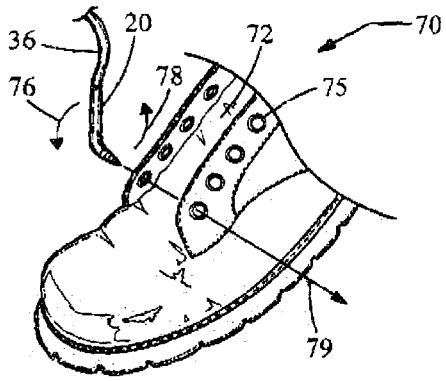
FIG. 3 is a partial perspective view of the threading assembly and lace which is shown in FIG. 1 in combination with an athletic shoe.

As shown in FIG. 3, the second threading assembly 20 is used upon a conventional athletic shoe 70 having a plurality of eyelets 75 which are partially obstructed by the tongue 72 of the athletic shoe 70. Particularly, the second assembly 20 may be used to negotiate through the eyelets 75 and around the tongue 72 due to the fixed position elbow 25. That is, the angle of the elbow 25 allows a user to thread the shoelace 36 through one of the plurality of eyelets 75 while concomitantly maneuvering the end 24 of the assembly 20 in the direction of the arrow 78 and the end 21 in the direction of the arrow 76, thereby permitting the end 24 to pass above the tongue 72 while the body 27 is substantially parallel with the arrow 79.

Figure 4:
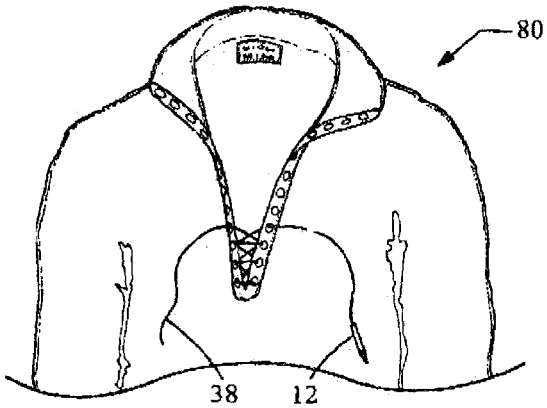
FIG. 4 is a partial perspective view of the threading assembly and lace which is shown in FIG. 2 in combination with a piece of apparel.

As best shown within FIG. 4, the first assembly 11 (e.g., or the second assembly 20) may be used in a coupled relationship with the leather lace 38 to perform a lacing task through a material, such as the material of the blouse or shirt 80. More particularly, either of the assemblies 11, 20 may be used as a conventional needle and thread if a garment, such as garment 80 needs to be re-laced or laced and lacks eyelets or apertures. That is, each of the assemblies 11, 20 have a respective and relatively sharp pointed end 19, 28 which are each capable of piercing substantially any desired material (e.g., material such as cotton, leather, suede, linen, and/or the like).

It should be appreciated that if a larger sized leather lace or shoe lace is desired to be threaded into apparel which cannot accommodate the desired size (e.g., the apertures of the apparel have an insufficient diameter to allow the diameter of the leather lace or shoelace through the apertures), a user may utilize the awl 30 in a conventional manner to enlarge or stretch substantially any sized existing aperture to accommodate substantially any sized aperture. The awl 30 may also be utilized to pierce material. For example and without limitation, the awl 30 may be used on a leather dress shoe to add more apertures (i.e., pierce the leather in order to allow a shoelace through the leather) or on a belt to add more apertures for the belt buckle to traverse through. It should also be appreciated that the conventional thimble 40 is included within the kit 10 to protect a user's finger from being impaled by any of the assemblies 11, 20.

It should be understood that this invention is not limited to the exact construction or embodiments listed and described, but that various changes may be made without departing from the spirit and scope of the invention.

What is claimed is:

1. A threading kit comprising:

at least one threading assembly which is generally tubular in shape, said at least one threading assembly having a first end, a second end, and a hollow body portion, wherein said first end comprises an aperture which allows access to a generally hollow cavity of said body portion, and wherein said second end is generally conical in shape and terminates at a substantially sharp point;

at least one package of lace; and a carrying case having a substantially soft filler material which separates said first threading assembly, said second threading assembly, and said package of leather lace, wherein said at least one threading assembly further comprises a first threading assembly and at least one second threading assembly, wherein said at least one second threading assembly further comprises and elbow portion, wherein said at least one second threading assembly is generally tubular in shape, said at least one second threading assembly having a first end, a second end, and a generally hollow body portion, wherein said first end comprises an aperture which allows access to a generally hollow cavity of said body portion, wherein said second end is generally conical in shape and terminates in a substantially sharp point, and wherein said second end is bent at an acute angle from said body portion at said elbow portion, wherein said first assembly further comprises a generally hollow body and a cavity, said first assembly and said at least one second threading assembly each further comprising substantially identical threading which is disposed within said cavities, wherein said at least one package of lace further comprises at least one length of lace having a pair of substantially identical ends, wherein one of said pair of substantially identical ends is selectively and frictionally coupled through one of said apertures of said first and said at least one second threading assemblies and frictionally fit within one of said cavities of said first and said at least one second threading assemblies, wherein said at least one package of lace further comprises a first package of shoelace and a second package of leather lace, and wherein said threading kit further comprises a thimble and an awl.

2. The threading kit of claim 1 wherein said carrying case comprises a base portion and a lid portion which is movably coupled to said base portion by a pair of substantially identical hinges.

3. The threading kit of claim 2 wherein said base portion further comprises a male and female fastening device and said lid portion further comprises a male and female fastening device, said male and female fastening device of said lid portion cooperating with said male and said female fastening device of said base portion to removably couple said lid portion to said base portion.

4. The threading kit of claim 3 wherein said filler material of said carrying case further includes a plurality of dissimilar recesses, said plurality of recesses each being respectively shaped to receive and hold a respective one of said first threading assembly, said at least one second threading assembly, said package of leather lace, said package of said shoelace, said thimble, and said awl.

5. A threading kit comprising:

a first threading assembly which is generally tubular in shape, said first threading assembly having a first end, a second end, and a hollow body portion, wherein said first end comprises an aperture which allows access to a generally hollow cavity of said body portion, and wherein said second end is generally conical in shape and terminates at a substantially sharp point;

a second threading assembly which is generally tubular in shape, said second threading assembly having a first end, a second end, a generally hollow body portion, and a fixed position elbow portion, wherein said first end comprises an aperture which allows access to a generally hollow cavity of said body portion, wherein said second end is generally conical in shape and terminates in a substantially sharp point, and wherein said second end is bent at an acute angle from said body portion at said fixed position elbow portion;

at least one package of lace; and a carrying case having a substantially soft filler material which separates said first threading assembly, said second threading assembly, and said package of leather lace, wherein each of said generally hollow cavities further comprise threading, wherein said carrying case comprises:

a base portion having a female and a male fastening device, said base portion receiving said filler material; and a lid portion which is movably coupled to said base portion by a pair of substantially identical hinges, said lid portion including a male fastening device and a female fastening device, wherein said male and female fastening device of said lid portion cooperates with said male and said female fastening device of said base portion to removably couple said lid portion to said base portion, wherein said filler material of said carrying case comprises:

a first recess which is shaped substantially similar to said first threading assembly;

a second recess which is shaped substantially similar to said second threading assembly; and at least a third recess which is shaped substantially similar to said at least one package of lace, wherein said threading kit further including a thimble and an awl, wherein said filler material of said carrying case further comprises:

a fourth recess which is shaped substantially similar to said awl; and at least a fifth recess which is shaped substantially similar to said thimble, and wherein said carrying case comprises:

a base portion having a female and a male fastening device; and a lid portion which is movably coupled to said base portion by a pair of substantially identical hinges, said lid portion including a male fastening device and a female fastening device, wherein said male and female fastening device of said lid portion cooperates with said male and said female fastening device of said base portion to removably couple said lid portion to said base portion.

* * * * *